US009314074B2

(12) United States Patent
Johnson et al.

(10) Patent No.: US 9,314,074 B2
(45) Date of Patent: Apr. 19, 2016

(54) WALLET WITH ROLLING O-RING HINGE

(71) Applicant: Obstructures LLC, Knoxville, TN (US)

(72) Inventors: Brian R. Johnson, Knoxville, TN (US); Matthew S. Hall, Auburn, AL (US); Nathan J. Matteson, Chicago, IL (US)

(73) Assignee: Obstructures LLC, Knoxville, TN (US)

( * ) Notice: Subject to any disclaimer, the term of this patent is extended or adjusted under 35 U.S.C. 154(b) by 293 days.

(21) Appl. No.: 14/037,553

(22) Filed: Sep. 26, 2013

(65) Prior Publication Data

US 2015/0083289 A1 Mar. 26, 2015

(51) Int. Cl.

| | |
|---|---|
| ***A45C 1/06*** | (2006.01) |
| *A45C 13/10* | (2006.01) |
| *A45C 13/30* | (2006.01) |

(52) U.S. Cl.

CPC . *A45C 1/06* (2013.01); *A45C 13/30* (2013.01); *A45C 2001/062* (2013.01); *A45C 2001/065* (2013.01); *A45C 2001/067* (2013.01); *A45C 2013/1061* (2013.01)

(58) Field of Classification Search

CPC .... A45C 1/06; A45C 13/30; A45C 2001/065; A45C 2011/186; B42F 17/32; B42D 5/001–5/008

See application file for complete search history.

(56) References Cited

U.S. PATENT DOCUMENTS 675,909 A * 6/1901 Shepherd ..... B42F 21/00 235/89 R
1,897,799 A * 2/1933 Haight ..... A47B 23/004 248/443
2,222,166 A * 11/1940 Beline ..... G09F 7/00 116/324
2,421,487 A * 6/1947 Dyck ..... B42D 5/001 281/50
3,841,477 A * 10/1974 Stark ..... B65D 71/02 206/425
3,970,129 A * 7/1976 Tepfer ..... A45C 11/18 150/149
5,558,921 A * 9/1996 Pavlik ..... B42D 5/005 206/214
5,952,637 A * 9/1999 Strunk ..... A63F 3/0023 16/225
6,203,230 B1 * 3/2001 Whang ..... B42B 5/12 281/27.3
9,125,464 B2 * 9/2015 Minn ..... A45C 1/06
2004/0126284 A1 * 7/2004 Lilly ..... G01N 1/2202 422/119
2008/0236712 A1 * 10/2008 Chisolm ..... A45C 15/00 150/132
2013/0056119 A1 3/2013 Henriette
2013/0206055 A1 * 8/2013 Moran Wexler ..... B42D 9/007 116/234

OTHER PUBLICATIONS

Gregory Venters, "Omega—Compact Solid Titanium Wallet," internet search May 14, 2013, i.e. http://www.kickstarter.com/projects/331414694/omega-compact-solid-titanium-wallet, pp. 1-38.

(Continued)

*Primary Examiner* — Tri Mai

(74) *Attorney, Agent, or Firm* — Luedeka Neely Group, P.C.

(57) ABSTRACT

A wallet for securely holding one or more documents having a first band plate and a second band plate connected together using a stationary O-ring and a rolling O-ring . Each plate includes a top edge, side edges, and a pivot edge. A notch is located in each of the side edges adjacent the pivot edge that receives and holds the stationary O-ring . At least one of the plates includes a channel located in each of the side edges between the notch and the top edge that receives and holds the rolling O-ring . The rolling O-ring is typically located at the top of the channel near the top edge. The O-ring s bias the plates to a closed. The stationary O-ring allows the plates to be stretched apart while keeping the pivot edge together. The rolling O-ring rolls down the channel to release tension holding the plates together.

20 Claims, 11 Drawing Sheets

(56) References Cited

OTHER PUBLICATIONS

Kenneth Lemus, "Kickstarter," Dizmio Wallet: Slim, Small, Minimal—RFID Blocking Wallet, internet search May 15, 2013, i.e. http://www.kickstarter.com/project/dizmio/dizmio-wallet-slim-small-minimal-rfid-blocking-wal, pp. 1-20.
Wilson Alvarez, "The MULTI," The First Multi-Tool Wallet!, internet search May 15, 2013, i.e. /http://www.kickstarter.com/projects/150007960/the multi-the-first-multi-tool-wallet, pp. 1-12.
"Elephant Wallet," ultra slim minimalist wallet, internet search May 15, 2013, i.e. /http://elephantwallet.com/.
Scott Hussa, "The HuMn Wallet," the best minimal RFID blocking wallet, internet search May 15, 2013, i.e. /http://www.kickstarter.com/projects/1127228691/the-humn-wallet-thebest-minimal-rfid-blocking-wal, pp. 1-29.
The Minimalist o-ring wallet by Umdesigns on Etsy, internet search May 15, 2013, i.e. /http://www.etsy.com/listing/76287001/the minimalist-o-ring-wallet, pp. 1-2.
CONSOLIWALLET—Wintercheck Factory, internet search May 15, 2013, i.e. wintercheckfactory.com/shop/13-consoliwallet, pp. 1-4.

* cited by examiner

WALLET WITH ROLLING O-RING HINGE

FIELD

This invention relates to the field of wallets and document carriers. More particularly, this invention relates to wallets and document carriers having an O-ring hinge connection.

BACKGROUND

Wallets are typically small flat cases that are used to carry personal items such as cash, credit cards, identification information, cards, photos, etc. These are typically made from leather or other fabrics and are usually pocket-sized and foldable. Document carriers, sometimes referred to as organizers, are similar to wallets except that they are often used to carry larger documents, such as passports, notebooks, files, documents, etc. Traditional wallets and documents carriers were often large and bulky. However, recently, wallets and document carrier are designed with minimalist construction to minimize their size.

Plate wallets are typically designed to carry, for example, one or two bank or credit cards, cash and an ID. These types of wallets are usually small enough to fit conveniently into the front or back pants pocket without causing discomfort or annoyance to the user. However, previous plate wallets are often not durable, difficult and expensive to manufacture and repair, and difficult to operate. Additionally, these wallets are often made in only one size, about the size of a credit card, which may not be large enough for other items that a user may wish to carry, such as a passport. Finally, these wallets are often bland, not aesthetically pleasing, or are overly complicated.

What is needed, therefore, is a plate-type wallet that is economical to manufacture, convenient to use, durable, and attractive and aesthetically pure.

SUMMARY OF THE CLAIMS

The above and other needs are met by a wallet for securely holding one or more documents. The wallet includes a first band plate, a second band plate, a stationary O-ring and a rolling O-ring. Each plate includes a top edge, side edges, a pivot edge, and notches in each of the side edges. Each notch is located adjacent the pivot edge and is configured to receive at least a portion of the stationary O-ring. At least one of the plates also includes a channel located in each of the side edges between the notch and the top edge. The stationary O-ring may be placed into the notches of the plates and the rolling O-ring may be placed into the channel of the plate. The stationary O-ring allows the plates to be separated at one end while being held together at the other end. In a closed position, the rolling O-ring maintains pressure on the plates, thereby holding any documents securely in the wallet. The rolling O-ring rolls down the channel to release tension and pressure on the plates is reduced as the plates are spread apart.

In certain embodiments, the wallet further includes a third plate having the same or similar construction as the first or second plate. The plates may each further include at least one tab section formed by the top edge, wherein each of the tab section are configured for arrangement such that at least a portion of each tab section is unobstructed by any other tab section. The plates may be rectangular-shaped plate or triangular-shaped.

Certain plates may include a locking mechanism that includes a second notch that is located in each of the side edges adjacent the top edge that is sized and configured to receive at least a portion of the rolling O-ring.

In certain embodiments, the outward-pointing corners of the top edge, side edges, pivot edge, notch and channel of each plate are blunted. The plates may be formed from an aluminum alloy. The exterior surface of one or more of the plates may be anodized.

In certain embodiments, a plate may include a cut out portion that is sized and configured for use as a bottle opener.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

In the following detailed description of the preferred and other embodiments, reference is made to the accompanying drawings, which form a part hereof. It is to be understood that other embodiments may be utilized, and that structural changes may be made and processes may vary in other embodiments.

As the term is used throughout this disclosure, "documents" refers generally to the contents of the wallet, including any document(s) that may be carried in a wallet or document carrier, other similar apparatus, including for example cash, credit cards, identification information, cards, photos, passports, notebooks, files, documents, tablets (e.g., iPads), etc.

Figure 1:
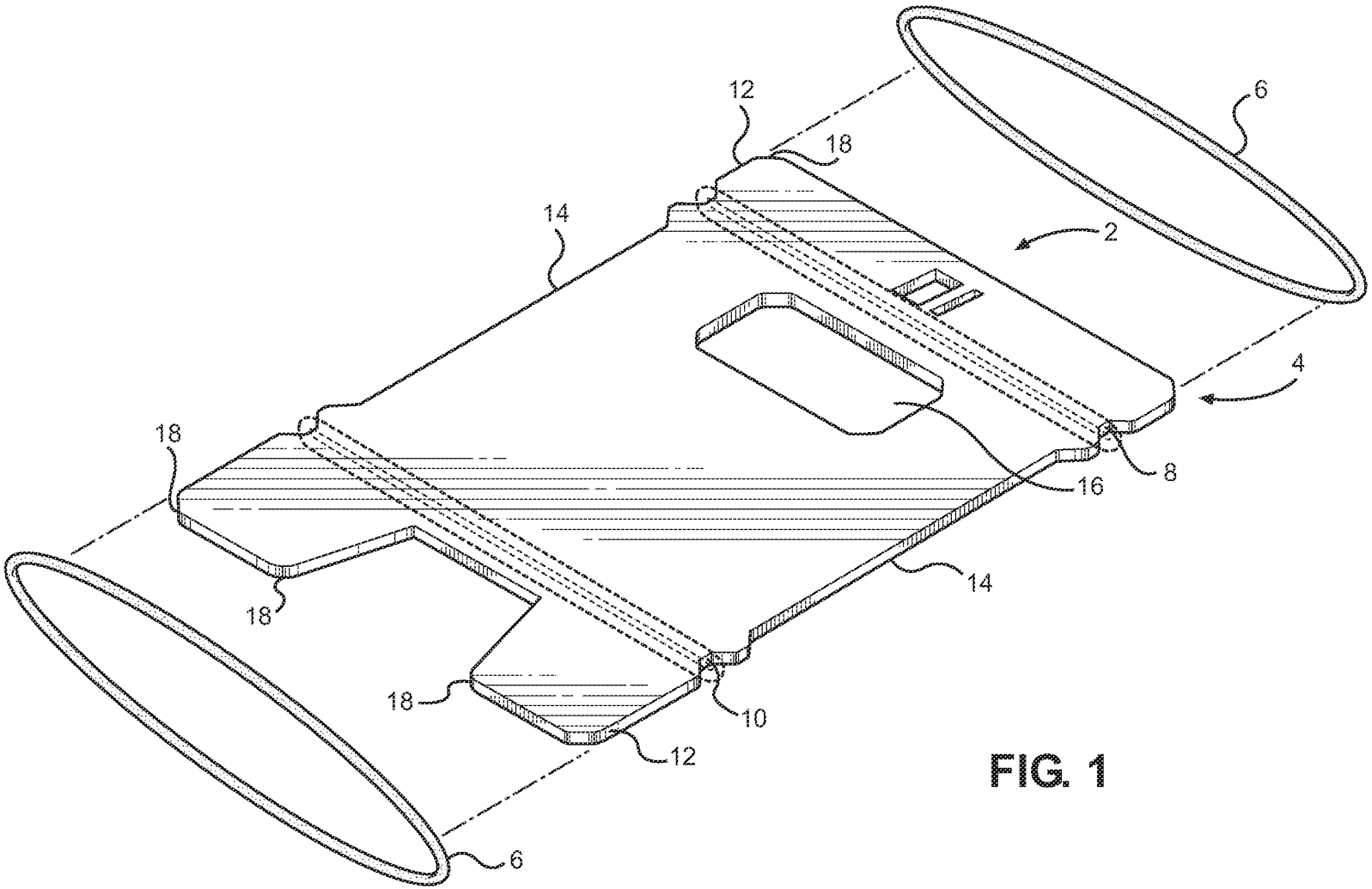
FIG. 1 shows an exploded view of a single plate wallet according to an embodiment of the present disclosure.

With reference now to the Figures and, in particular, to FIG. 1, there is provided a document carrier according to an embodiment of the present disclosure and generally referred to herein as a wallet 2. In general, the wallet 2 includes one or more rigid plates 4 and at least one, but preferably two or more pliable O-rings 6. However, a preferred embodiment includes two or more rigid plates 4 and two pliable O-rings 6, wrapped around the plates to hold them together.

Figure 2:
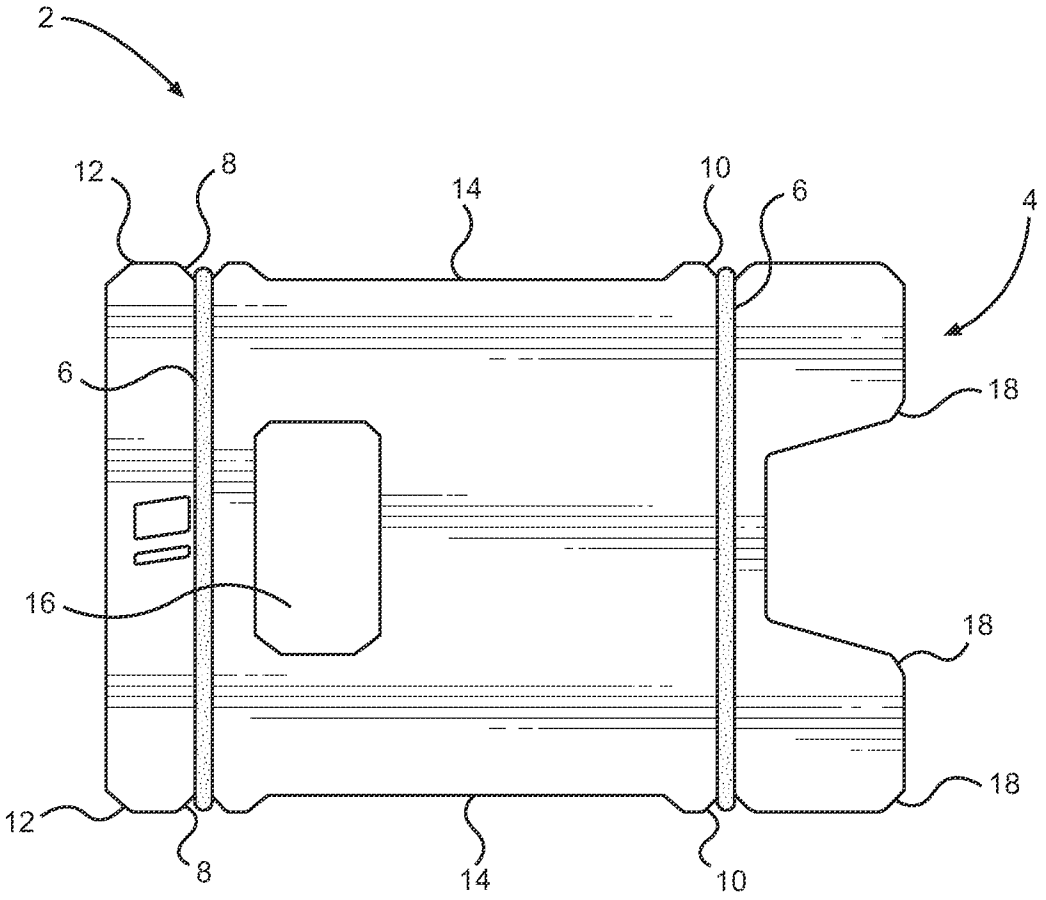
FIG. 2 shows a front view of a single plate wallet according to an embodiment of the present disclosure.

The plate 4 may include a first set of notches 8 and a second set of notches 10 that are formed into each side 12 of the plate. These notches 8, 10 are substantially the same and, in the discussion that follows, the description of notches 8 also applies to notches 10, unless otherwise specified. Each notch 8 is sized and configured to receive one O-ring 6. In particular, as shown in FIG. 2, the O-ring 6 is wrapped around the plate 4 and then seated and held securely in the notches 8 on each side 12.

Additionally, the wallet 2 may also include one or more channels 14 that are also formed along the sides 12 of the plate 4. As with the notches 8, the channels 14 are also sized and configured to receive and securely hold O-rings 6. However, unlike the notches 8 that securely fix the O-ring 6 in substantially one position and location, the O-ring 6 can roll along the length of the channel 14.

The plates 4 may include several convenience features that make carrying a wallet of this design more convenient, safe and enjoyable. For example, the plates 4 may optionally include a window 16 that is integrated into the plate and is sized and configured for use as a bottle opener. Another convenient feature is rounded, blunted beveled or chamfered corners 18. The purpose of these types of corners 18 is to prevent sharp, harsh edges that may cause injury to the user or the user's clothing, or other material or fabric it may come into contact with (e.g., pockets, bag, etc.). Additionally, forming the corners 18 in this way allows the wallet 2 to be inserted and removed from pockets more easily than would a similar wallet having sharp, harsh corners.

Plates 4 are made using a rigid material of sufficient thickness to make them durable and strong for everyday use as a wallet. For example, preferably, the plates 4 should be sufficiently strong so as not to be damaged when placed in a user's pocket and sat upon. However, for the sake of convenience and in recognizing that the wallet 2 will most likely be carried on the user's person, the plates 4 are preferably made from a lightweight material. Finally, to simply the construction of the wallets 2, the plates 4 should be made from a material that is easy to machine and customize.

For example, a suitable material may be 1/16" aluminum plate. However, any material having the properties described above would suffice. One benefit of selecting aluminum is that it has RFID blocking properties that would help to prevent the content of the wallet from being scanned with RFID scanners. This may be particularly useful, for example, if the contents of the wallet contained confidential or personal information that was susceptible to RFID scanners, such as a passport.

Another benefit of using aluminum is that it may be surface treated, including anodized, which may increase corrosion and wear resistance and provide better adhesion for paint primers and adhesives, etc. than does bare metal. Additionally, anodizing the material can be used for cosmetic effects such as surface coloring, dyeing, printing, and a wide variety of other finishes, textures and designs. Finally, aluminum is easily machined and customized, including for example, custom engravings or etchings into the outer surfaces of the plates.

The plates 4 may be formed in a variety of shapes, sizes, and configurations. For example, the plates may be generally rectangular or triangular in shape. Of course, this invention is not limited by the precise number, shape or configuration of plates 4. Rather, users may customize their wallet 2 using different numbers, shapes and sizes of plates, such that one user's wallet may be entirely different from another user's wallet. In particular, the wallet may be customized according to the user's need and the wallet's bulk and storage capacity may be reduced or expanded by removing or adding additional plates. Further, different types of plates may provide different functionality depending on the needs of the user.

Figure 3:
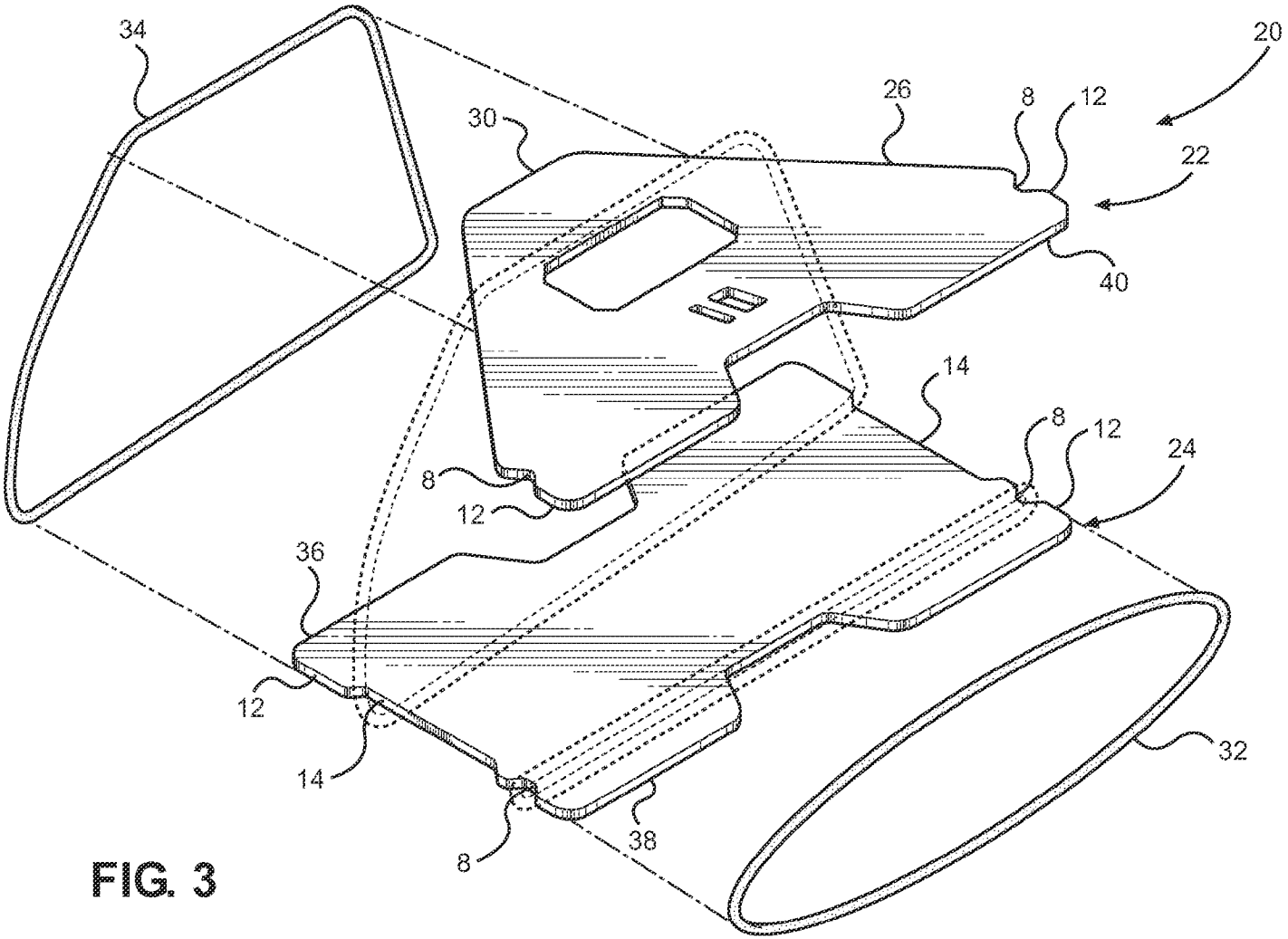
FIG. 3 shows an exploded view of a two-plate wallet according to an embodiment of the present disclosure.

The two-plate wallet 20 shown in FIG. 3 includes a generally triangular plate 22 and a generally rectangular plate 24, a stationary O-ring 32, and a rolling O-ring 34. The O-rings 32, 34 provide tension and are used to secure the contents of the wallet 20 on or between the plates 22, 24. The O-rings are sized to allow for the correct amount of tension and flexibility for easy use as well as durability.

Another advantage is that the wallet may be repaired when necessary by the user. With repeated or extended use, it is expected that the O-rings will eventually fatigue and break. Other plate wallets cannot be simply and easily repaired. In those designs, it is common for two loose ends of a tensioning mechanism (e.g., elastic band) be inserted through two different portions of the wallet itself and then clamped or otherwise permanently joined together. Since most users won't have the tools necessary to properly clamp or join a replacement elastic band, the wallet could not be easily repaired once the origin band broke. By contrast, the wallet of the present disclosure places the tensioning mechanism around an outside edge of the wallet such that an O-ring may be used and no joining operation is required. If the original O-ring breaks, it can be replaced by a new O-ring very easily without the use of any tools or any additional joining steps.

Therefore, it is preferable to select an O-ring that is fairly common. In addition to making the wallets easy to open, the use of common O-rings allows for a non-proprietary, user serviceable and economical way to join the plates. A suitable O-ring for the credit card sized wallet is the A50 Buna-Nitrile O-ring.

Opposing side edges 12 of the plates 22, 24 may include a notch 8 that is positioned near a lower pivot edge 38 of the rectangular plate and lower pivot edge 40 of the triangular plate 22. The notch 8 is designed to receive the stationary O-ring 32, which remains stationary within the notch whether the wallet 20 is in an open position or a closed position and during the transition from one position to the other. Once the stationary O-ring 34 has been properly seated within the notch 8 it serves a several purposes, including securing together the plates 22, 24, aligning the plates, and also acting as a hinge-type connection between the plates, such that the plates are able to rotate away from one another, on one side, while remaining connected together, on the other side.

Another benefit of the O-rings 32, 34 is that they provide padding to prevent the plates 22, 24 from scratching or damaging surfaces. For example, if the wallet 20 were placed onto a table, the O-rings 32, 34 would hold the plates 22, 24 away from the surface of the table. Furthermore, the O-rings 32, 34 will assist in protecting the outer surface of the plates 22, 24 from being damaged. For example, if the wallet 20 is placed or dropped onto a rough surface, such as the ground, the O-rings 32, 34 would offer some protection against scratches and dents to the plates 22, 24.

Both opposing side edges 12 of certain plates, including those of the rectangular plate 24 include an elongate channel 14. The channel 14 may be located at any position along the side 12. The channel 14 shown is located approximately at the center of the side 12 of the plate 24 and is adjacent the aforementioned notch 8. The channel 14 receives and securely holds the rolling O-ring 34, which, when corrected positioned, rolls along the channel 14.

Figure 4:
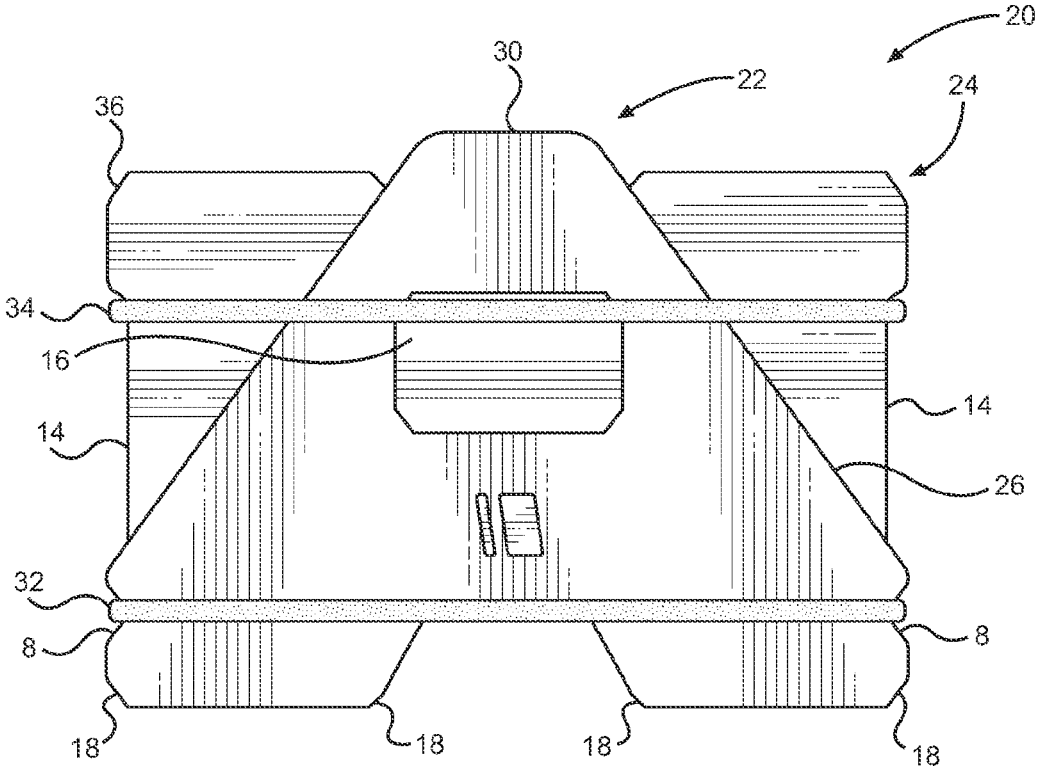
FIG. 4 shows a front view of a two-plate wallet according to an embodiment of the present disclosure.
Figure 5:
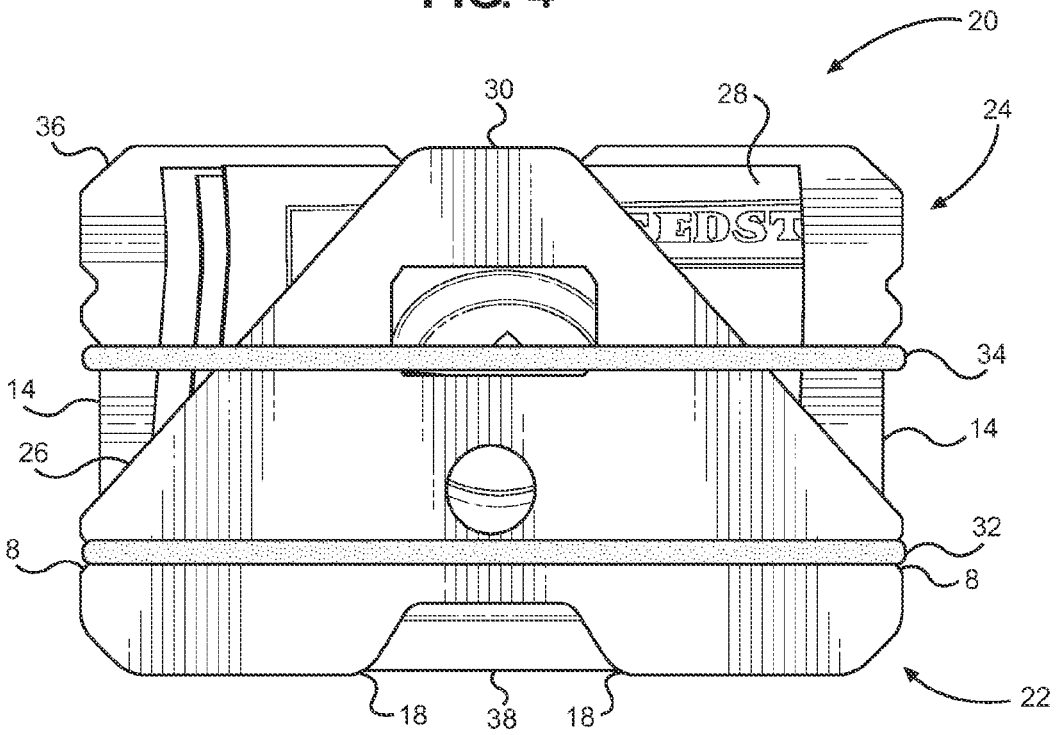
FIG. 5 shows a front view of a two-plate wallet including currency according to an embodiment of the present disclosure.

When the wallet 20 is in a closed position, as shown in FIGS. 4 and 5, the rolling O-ring 34 is positioned at the top of the channel 14 nearest the pointed tip 30 of the triangular plate 22 and the top edge 36 of the rectangular plate 24. The wallet 20 is opened by spreading the top of the plates 22, 24 apart, while the bottom of the plates remain together and serve as a pivot point. When a wallet consists of one rectangular plate 24 and one triangular plate 22 as shown, minimal rolling is induced by the action of spreading the two plates apart, thus reducing the extent to which the tension on the plates is reduced. However, the rolling action may be manually assisted as the plates are spread. In this particular embodiment, the top edge 36 of the rectangular plate 24 and the pointed tip 30 of the triangular plate 22 are spread apart to open the wallet 20.

In doing so, the stationary O-ring 32 remains seated in the notch 8. However, the rolling O-ring 34 rolls down the channel 14 towards a lower edge 38 of the rectangular plate 24 until reaching the lower end of the channel, which arrests further movement of the rolling O-ring. As the rolling O-ring 34 rolls downwards, tension in the O-ring 34 and pressure on the plates 22, 24 is reduced, thereby making it easier to hold the plates apart and to access the contents of the wallet 20.

Both the length of the channel 14 and the position of the notch 8 were selected to allow for easy and comfortable operation of the wallet 20 while maintaining sufficient tension to securely hold the contents within the wallet. For example, in certain embodiments, the length of the channel is approximately ⅓ to ½ the width of the wallet. The size of the wallet may be inversely proportional to the length of the channel such that a larger wallet has a small channel and a smaller wallet has a larger channel. Accordingly, an advantage of this design is that it allows for proper tension to securely hold documents in the wallet when close, but the tension is easily released when opened to simplify access to those documents.

Figure 6:
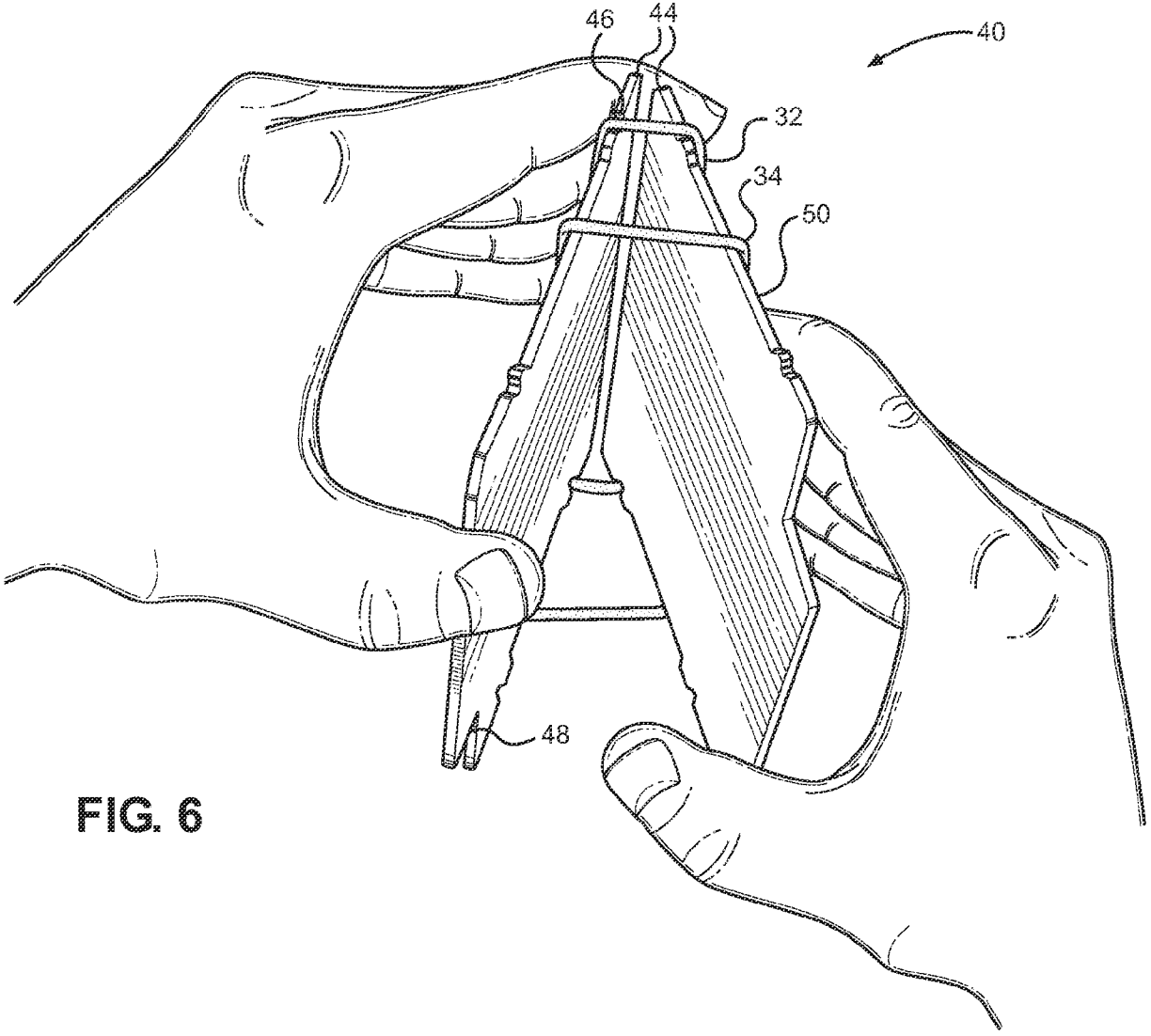
FIG. 6 shows a two-plate wallet in a partially open position according to an embodiment of the present disclosure.
Figure 7:
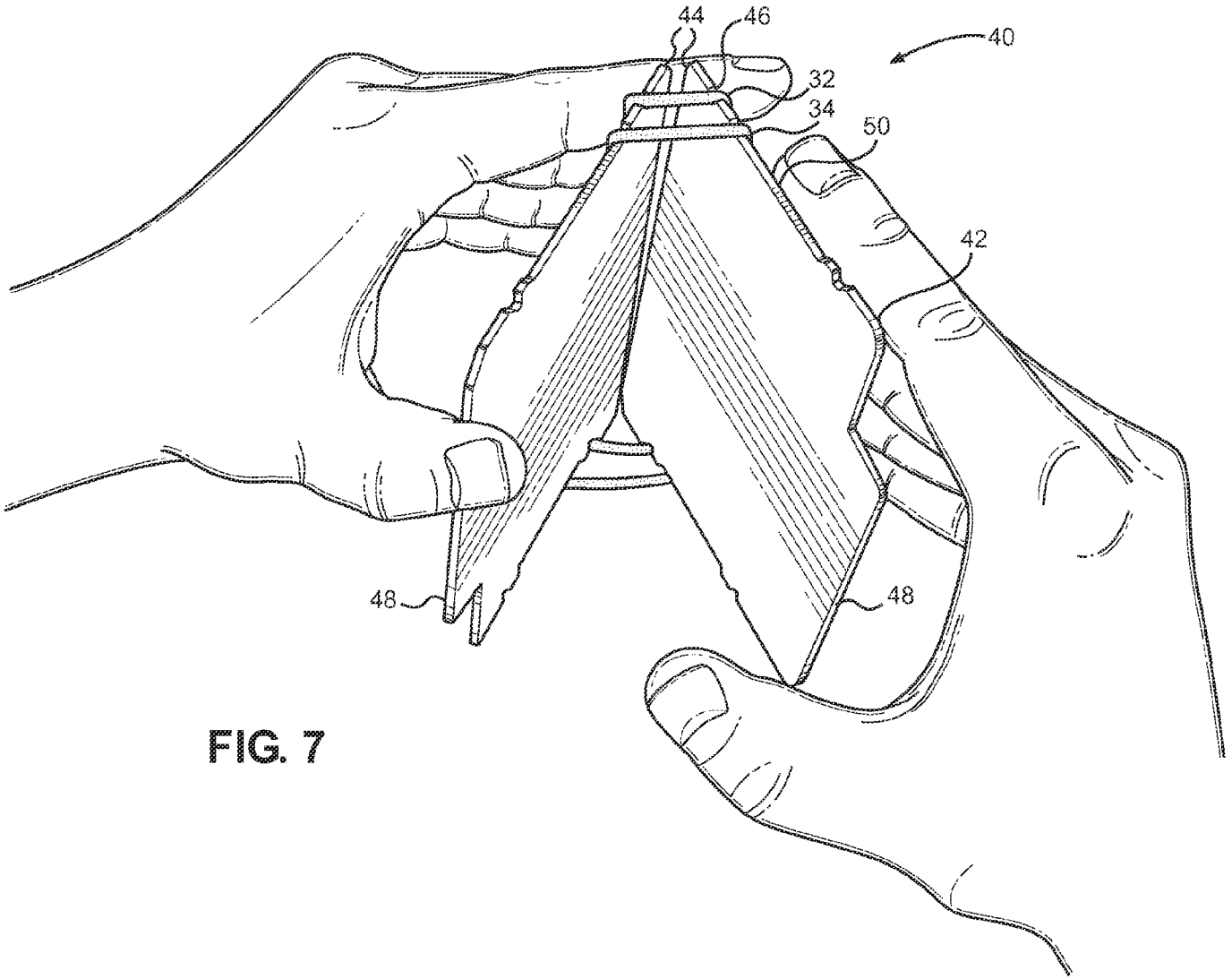
FIG. 7 shows a two-plate wallet in a fully open position according to an embodiment of the present disclosure.

This rolling action is shown in FIGS. 6 and 7, which shows a two-plate wallet 40 having two identical rectangular plates 42 that have been connected together with a stationary O-ring 32 and a rolling O-ring 34. When a wallet includes two rectangular plates having channels, the act of spreading the top edges of the plates apart induces the O-ring to roll down the channels of the plates simultaneously. This rolling action lessens the tension on the two plates and provides access to the documents. In other words, the rolling O-ring 34 is used to adjust the amount of tension holding the plates 42 together. In the closed position the rolling O-ring 34 is preferably located at the top end of the channel 50 furthest from the stationary O-ring 32. This provides the maximum amount of tension and serves to keep the contents of the wallet 40 secure.

This spreading action causes the rolling O-ring 34 to roll along the channel 50 towards the pivot edge 44 of the plates 42. The rolling O-ring 34 will continue to roll until it comes to rest at the end of the channel 50. For example, the wallet 40 in FIG. 6 is shown in a partially open position. The stationary O-ring 32 is seated in a notch 46 near the pivot edge 44 of the two plates 42. The rolling O-ring 34 has partially rolled down the channel 50 of the plates 42, away from the top edge 48 and toward the pivot edge 44.

In FIG. 7, the wallet 40 is shown in a fully open position. The rolling O-ring 34 has now at the end of the channel 50 nearest the pivot edge 44. The remaining tension on the plates 42 is sufficient to cause them to be snapped back closed once the pressure holding them apart is released. The rolling O-ring 34 is then manually moved back to its original position at the top of the channel 50.

By contrast, when a wallet consists of only a single plate, such as the one shown in FIG. 2, the documents effectively act as a second plate, and the rolling action must be induced manually in order to manipulate the O-ring.

Figure 8:
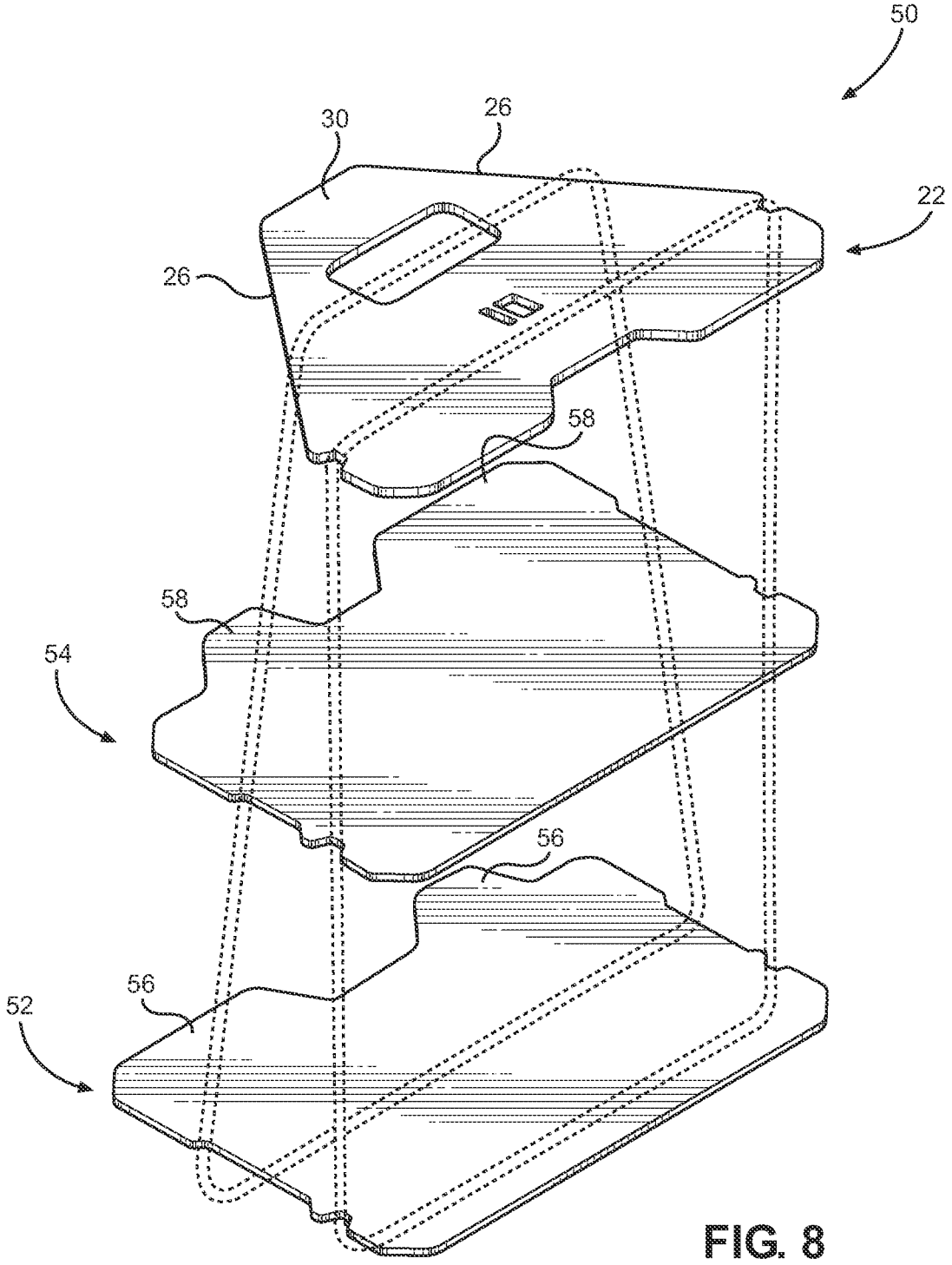
FIG. 8 shows an exploded view of a three-plate wallet according to an embodiment of the present disclosure.
Figure 9:
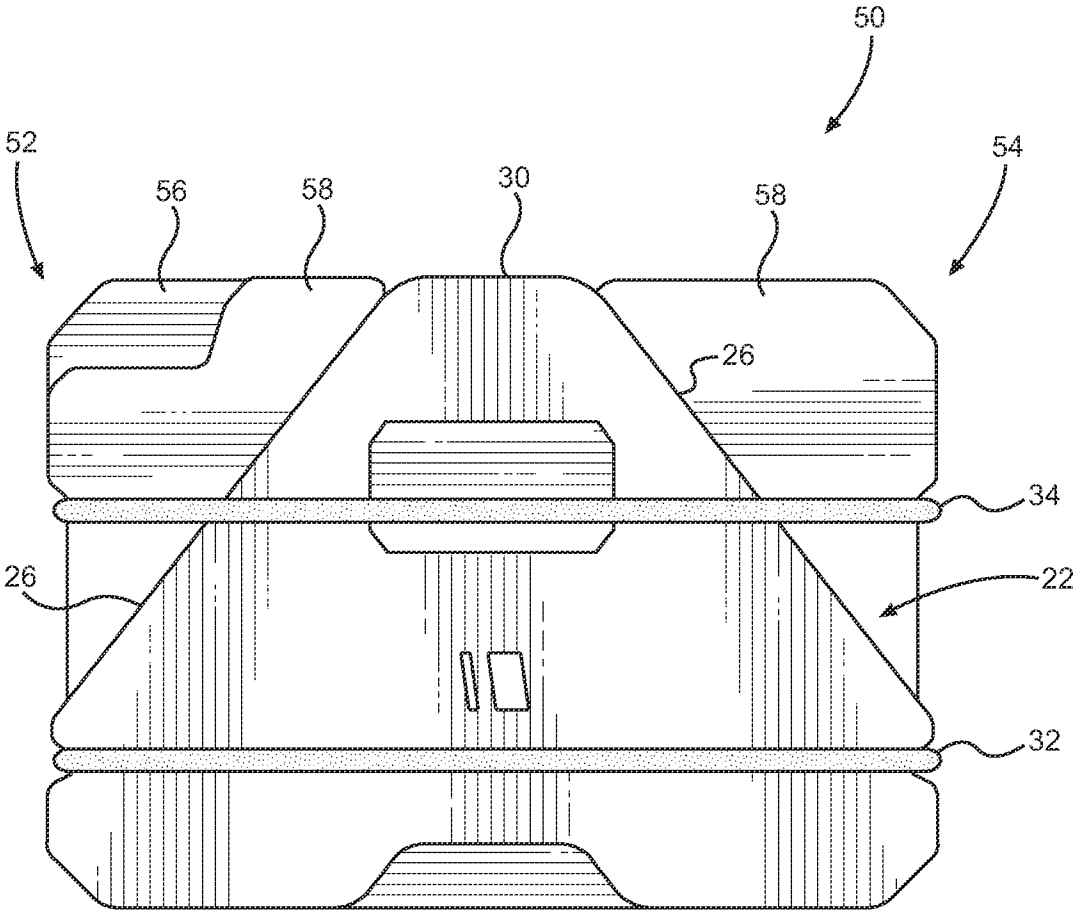
FIG. 9 shows a front view of a three-plate wallet according to an embodiment of the present disclosure.

Next, the wallet 50 shown in FIGS. 8 and 9 is a three-plate version, which includes a triangular plate 22 that is identical that shown in FIG. 3. However, the wallet 50 also includes two identical rectangular plates, including a first rectangular plate 52 and a second rectangular plate 54.

The plates may further include one or more tabs that are formed along their top edge that assist in the manipulation of the various plates and, when multiple plates are present, for each section of the wallet to be separately opened, accessed and closed. For example, the first rectangular plate 52 may include one or more tabs 56. Similarly, the second rectangular plate 54 may including one or more tabs 58. Finally, the pointed top 30 of the triangular plate 22 may function as a tab. Ideally, as shown in FIG. 9, when one or more plates having tabs are stacked together, those tabs 30, 56, 58 are arranged such that they do not overlap, thereby allowing for purchase with a finger or thumb.

The second rectangular plate 54, which may also be referred to as the "divider plate" is sandwiched between (i.e., divides) the first rectangular plate 52 and the triangular plate 22. The first rectangular plate 32 and the triangular plate 24 may be referred to as "band plates."

The primary distinction between a "band plate" and a "divider plate" is the location within the wallet. A band plate is any plate that is the outermost plate of the wallet. By contrast, a divider plate is any plate that is positioned between two band plates. Therefore, each wallet will have a minimum of one and a maximum of two band plates, but may include any number of divider plates between two band plates.

An advantage of having multiple plates and the hinge opening, as described above, is that individual sections or partitions are formed between each pair of plates. This forms a filing cabinet-type of arrangement, which allows documents to be organized and placed into separate sections easily and quickly. For example, cash, cards and other documents may be divided into three different sections of the wallet. Further, individual documents may be inserted, accessed and removed from the wallet without requiring those documents to be inserted or removed as a stack of documents.

Figure 10:
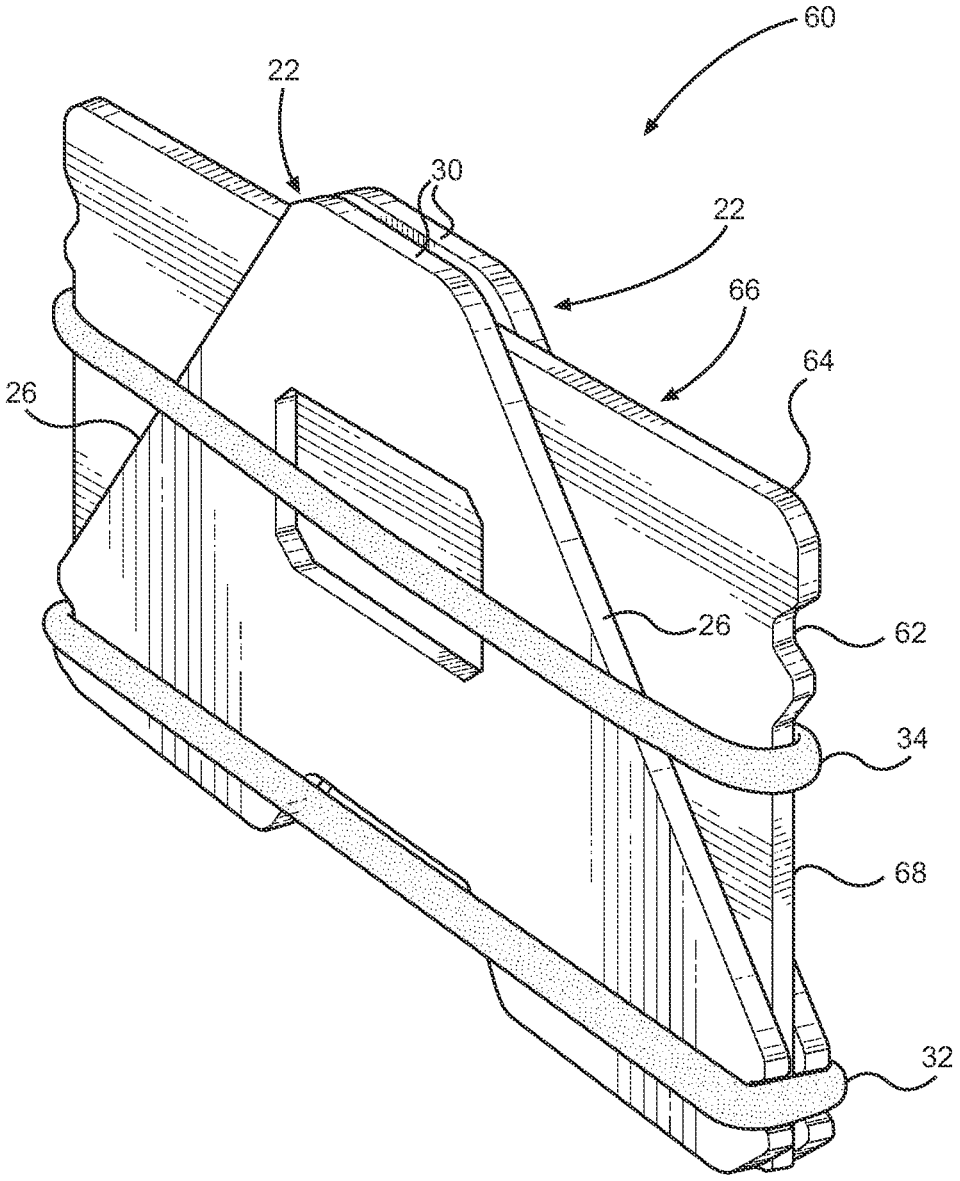
FIG. 10 shows a perspective view of a three-plate wallet according to an embodiment of the present disclosure.

In certain embodiments, as shown in FIG. 10, a triangular plate 22, which does not have a channel, may be used as band plate (i.e., it is the outermost plate of the wallet). In that case, the rolling O-ring 34 rolls along the sloped side edge 26 of the plate 22. Preferably, at least one plate 66 having a channel is used in connection with the triangular plates 22, either as a band plate or a divider plate, so that the rolling O-ring 34 can be held seated into the channel securely.

One benefit of the triangular plate 22 is that it allows for easy access to contents of the wallet 20 without having to open the wallet, because the angled sides 26 of the plate 22 do not completely cover the rectangular plates 52, 54 once all of the two plates are stacked together. As illustrated in FIG. 5, this design allows portions of the contents 28 of the wallet 20 to remain exposed even after being placed into the wallet. This provides easy and convenient access to the contents 28 of the wallet 20. Additionally, as shown in FIG. 10, due to its pointed tip 30 and the fact that the angled sides 26 do not have notches or a channel, as previously mentioned, the triangular plate 22 may be more easily inserted into the wallet 60 or under O-rings 32, 34.

In certain embodiments, the wallet 60 may include a second locking notch 62 that is used to lock the wallet 60 into a closed position. The locking notch 62 is located adjacent the top edge 64 of at least one plate. The wallet 60 shown in FIG. 10 includes one rectangular divider plate 66, two identical triangular band plates 22, a stationary O-ring 32 and a rolling O-ring 34. The locking notch 62 is located between the channel 68 and the top edge 64 of the divider plate 66. To lock the plates 22, 66 together, the rolling O-ring 34 is moved from the channel 68 into the locking notch 62. Attempts to spread the plates 22, 66 will not work and the wallet 60 will remain closed because the rolling O-ring's will be securely held within the locking notch 62.

Figure 11:
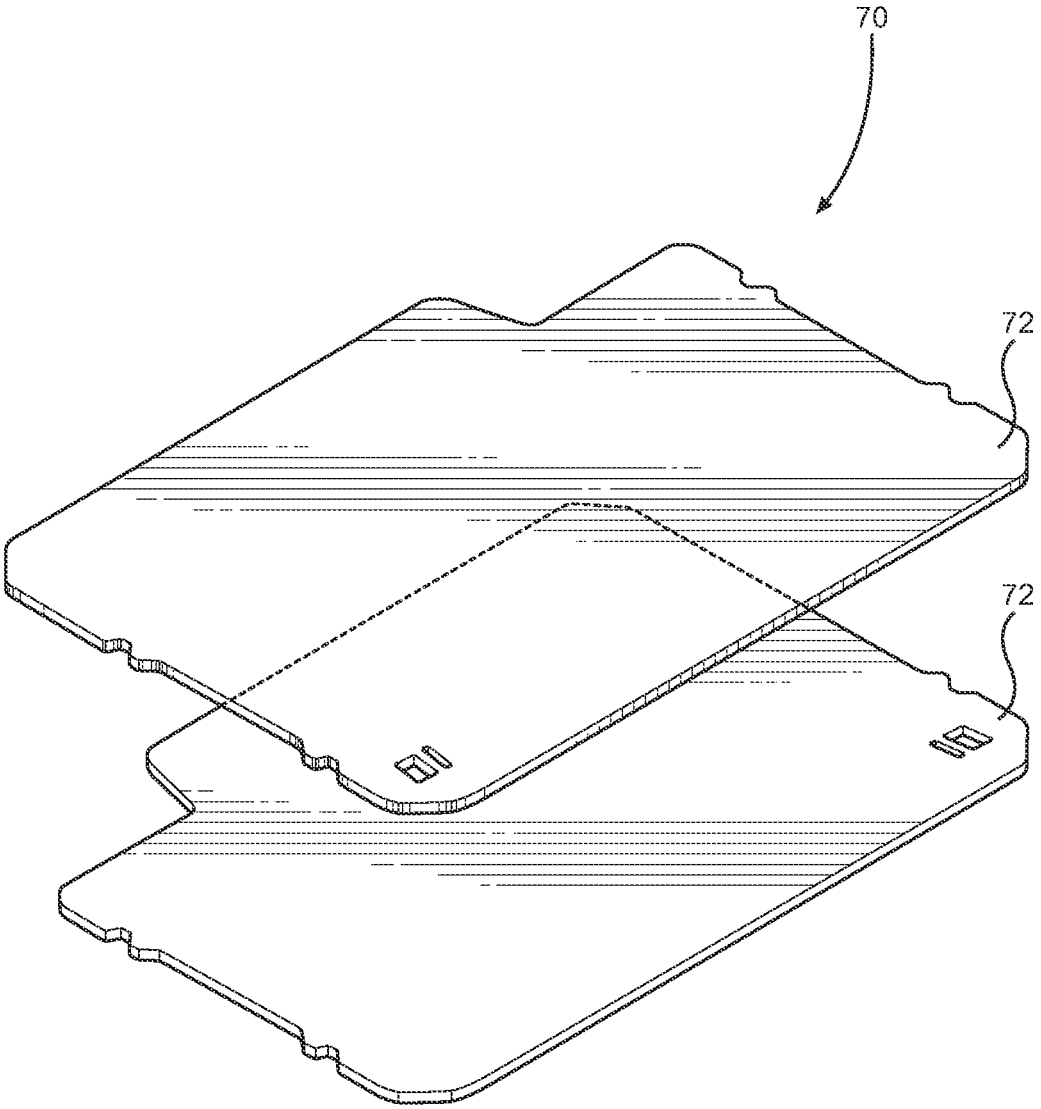
FIG. 11 shows an exploded view of a passport-sized two-plate wallet according to an embodiment of the present disclosure.
Figure 12:
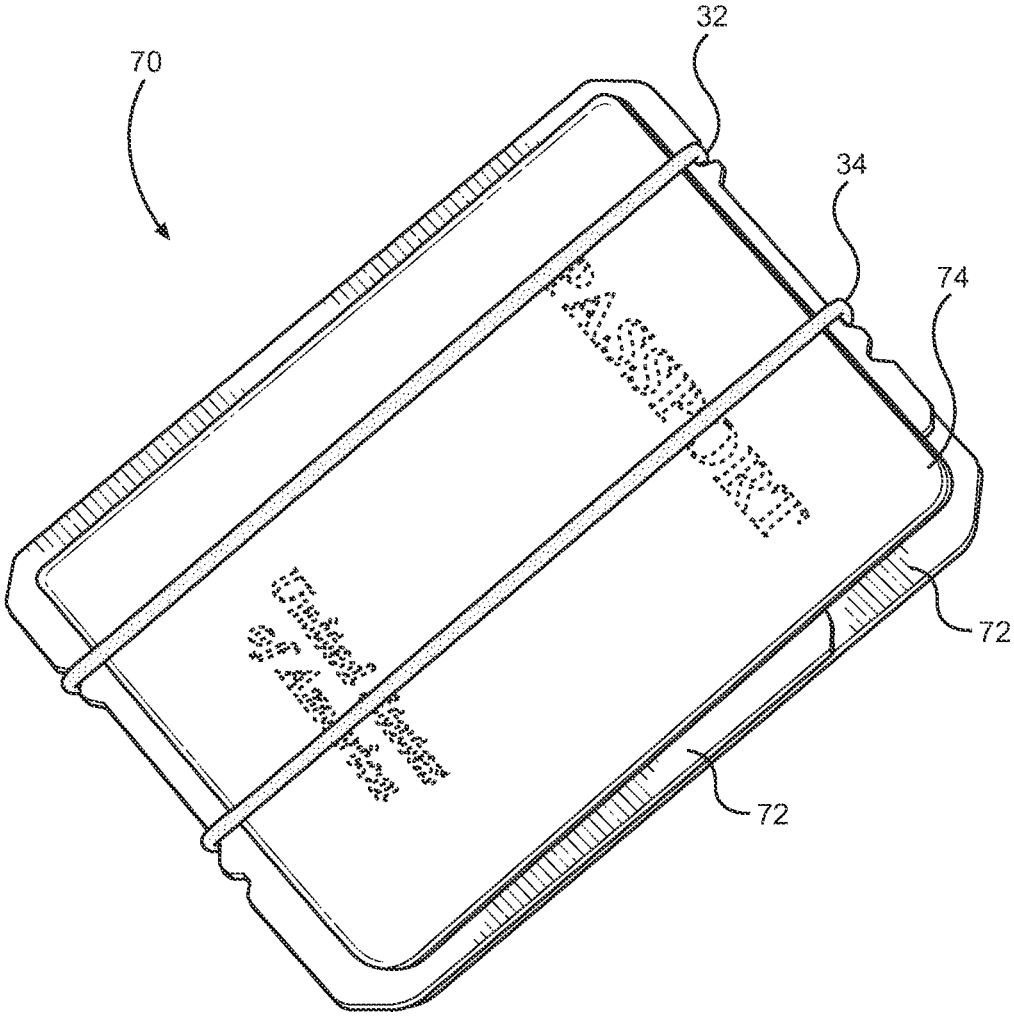
FIG. 12 shows a front view of a passport-sized two-plate wallet including a passport according to an embodiment of the present disclosure.

The size of the wallet may be scaled up or scaled down to accommodate different sized documents. For example, the wallet may be sized to hold credit card or business card sized documents, passport or foreign (e.g., European) currency, notebooks or legal pads or tablet PCs. For example, the wallet 70 shown in FIGS. 11 and 12 shows a larger wallet that includes two identical rectangular band plates 72. Large documents, such as a passport 74, may be placed between the plates 72 or under the O-rings 32 and 34.

Also, as mentioned before, the number of plates may be increased or decreased. The mode of operation may change depending on the number and particular shape or configuration of the plates and O-rings. For example, for single plate wallets, such as the one shown in FIG. 1, documents are placed on the outside surface of the one band plate 4 and are held in place simply by the O-rings. When two or more plates are used, documents may be placed between the plates, as shown in FIG. 5, or on the outside surface of the band plates and under O-rings, as shown in FIG. 12. When a wallet having three or more plates (i.e., two band plates and at least one divider plate) is opened, documents may be placed into and accessed on either side of the divider plate, which may then be pivoted within the wallet so that documents may be placed or accessed on the opposite side of the divider plate.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method for securing documents using an O-ring wallet, the method comprising the steps of:

providing a stationary O-ring ;

providing a rolling O-ring having a round cross section;

providing a first and second rigid plate, each plate comprising: a top edge, side edges, a pivot edge, a first notch disposed in each of the side edges adjacent the pivot edge and sized and configured to receive at least a portion of the stationary O-ring , and wherein at least one of the plates further comprises an elongate channel disposed in each of the side edges between the first notch and the top edge, the channel sized and configured to receive at least a portion of the rolling O-ring and the channel having a first end proximate the top edge and a second end proximate the notch of the at least one plate;

stacking the first and second plates together such that the first notches in the side edges of the first plate are aligned with the first notches in the side edges of the second plate;

wrapping the stationary O-ring around outward facing surfaces of both the first and second plates and seating a portion of the stationary O-ring into the first notch on both sides of both plates; and wrapping the rolling O-ring around outward facing surfaces of both the first and second plates and seating a portion of the rolling O-ring proximate the first end of the channel, opening the wallet by separating the top edges of the plates to transition the wallet from a closed position where the sides of the plates are substantially parallel to one another and the rolling O-ring is located proximate the first end of the channel to an open position where the pivot edges of the plates are held together by the stationary O-ring, the top edges of the plates are separated and the rolling O-ring is located proximate the second end of the channel, wherein separating the top edges of the plates causes the rolling O-ring to roll from the first end of the channel to the second end of the channel;

placing a document between the first and second plates;

closing the wallet so that the sides of the plates are substantially parallel to one another and the document is secured between the plates; and rolling the rolling O-ring from the second end of the channel to the first end of the channel.

2. The method of claim 1 further comprising the steps of providing a third plate comprising a top edge, side edges, a pivot edge, a first notch disposed in each of the side edges adjacent the pivot edge and sized and configured to receive at least a portion of the stationary O-ring, inserting the third plate between the first and second plates, aligning the first notches of all three plates, and seating a portion of the stationary O-ring into the first notch on both sides of the third plate.

3. The method of claim 1 wherein each of the plates is a rectangular-shaped plate or a triangular-shaped plate.

4. The method of claim 1 wherein the first and second plates each further comprise at least one tab section formed by the top edge, wherein each of the tab sections are configured for arrangement such that at least a portion of each tab section is unobstructed by any other tab section.

5. The method of claim 1 further comprising the step of providing an insignia on at least one of the exterior surfaces of at least one of the plates.

6. The method of claim 1 wherein the plates are formed from an aluminum alloy.

7. The method of claim 1 further comprising the step of blunting outward-pointing corners of the top edge, side edges, pivot edge, notch and channel.

8. The method of claim 1 wherein at least one of the first and second plates further comprises a second notch disposed in each of the side edges adjacent the top edge and is sized and configured to receive at least a portion of the rolling O-ring.

9. The method of claim 1 further comprising the step of forming a cut out portion in at least one of the plates, wherein the cutout is sized and configured for use as a bottle opener.

10. The method of claim 1 further comprising the step of anodizing the exterior surface at least one of the plates.

11. A wallet for securely holding one or more documents, the wallet comprising:

a first band plate and a second band plate, each plate comprising: a top edge, side edges, a pivot edge, a notch disposed in each of the side edges adjacent the pivot edge and sized and configured to receive at least a portion of a stationary O-ring, and wherein at least one of the plates further comprises an elongate channel disposed in each of the side edges between the notch and the top edge, the channel sized and configured to receive at least a portion of a rolling O-ring and the channel having first end proximate the top edge and a second end proximate the notch of the at least one plate;

the stationary O-ring sized and configured for placement into the notches of both the first and second plates; and the rolling O-ring sized having a round cross section and configured for placement into the channel and to roll along the side edges of the at least one plate in the channel and to stop rolling once it reaches either the first end or the second end of the channel, wherein the wallet is configured to transition from a closed position where the sides of the plates are substantially parallel to one another and the rolling O-ring is located proximate the first end of the channel to an open position where the pivot edges of the plates are held together by the stationary O-ring, the top edges of the plates are separated and the rolling O-ring is located proximate the second end of the channel, wherein separating the top edges of the plates causes the rolling O-ring to roll from the first end of the channel to the second end of the channel.

12. The wallet of claim 11 further comprising a third plate comprising a top edge, side edges, a pivot edge, a notch disposed in each of the side edges adjacent the pivot edge.

13. The wallet of claim 11 wherein the first and second plates each further comprising at least one tab section formed by the top edge, wherein each of the tab section are configured for arrangement such that at least a portion of each tab section is unobstructed by any other tab section.

14. The wallet of claim 11 wherein each of the first and second plates is a rectangular-shaped plate or a triangular-shaped plate.

15. The wallet of claim 11 wherein at least one of the first and second plates comprises a second notch disposed in each of the side edges adjacent the top edge, the second notch sized and configured to receive at least a portion of the rolling O-ring.

16. The wallet of claim 11 wherein outward-pointing corners of the top edge, side edges, pivot edge, notch and channel of each plate are blunted.

17. The wallet of claim 11 wherein at least one of the plates is formed from an aluminum alloy.

18. The wallet of claim 11 wherein the exterior surface of at least one plate has been anodized.

19. The wallet of claim 11 further comprising a cut out portion in at least one of the plates, wherein the cutout is sized and configured for use as a bottle opener.

20. A wallet for securely holding one or more documents comprising:

a first rectangular-shaped band plate, a second rectangular-shaped band plate, and a third triangular-shaped band plate, each plate formed from an aluminum alloy and further comprising:

a top edge forming tab sections, wherein each of the tab sections is configured for arrangement such that at least a portion of each tab section is unobstructed by any other tab section;

side edges;

a pivot edge; and a notch disposed in each of the side edges adjacent the pivot edge and sized and configured to receive at least a portion of a stationary O-ring;

each rectangular band plate further comprising a channel disposed in each of the side edges between the notch and the top edge and sized and configured to receive at least a portion of a rolling O-ring;

the stationary O-ring sized and configured for placement into the notches of each of the plates; and the rolling O-ring sized and configured for placement into the channel of each of the rectangular plates; and wherein outward-pointing corners of the top edge, side edges, pivot edge, notch and channel are blunted.

* * * * *